US008919017B2

(12) United States Patent
Matsumoto

(10) Patent No.: US 8,919,017 B2
(45) Date of Patent: Dec. 30, 2014

(54) GRAPPLE BUCKET APPARATUS

(75) Inventor: Ryozo Matsumoto, Kasuya-gun (JP)

(73) Assignee: Matsumoto System Engineering Co., Ltd., Fukuoka (JP)

( * ) Notice: Subject to any disclaimer, the term of this patent is extended or adjusted under 35 U.S.C. 154(b) by 0 days.

(21) Appl. No.: 13/877,046

(22) PCT Filed: Sep. 30, 2011

(86) PCT No.: PCT/JP2011/073157

§ 371 (c)(1),
(2), (4) Date: Mar. 29, 2013

(87) PCT Pub. No.: WO2012/043888

PCT Pub. Date: Apr. 5, 2012

(65) Prior Publication Data

US 2013/0192098 A1 Aug. 1, 2013

(30) Foreign Application Priority Data

Sep. 30, 2010 (JP) ..... 2010-221820
Sep. 28, 2011 (JP) ..... 2011-212598

(51) Int. Cl.
*E02F 3/96* (2006.01)
*E02F 3/40* (2006.01)

(52) U.S. Cl.
CPC ..... *E02F 3/404* (2013.01)
USPC ..... 37/406; 144/4.1; 144/34.5

(58) Field of Classification Search
USPC ..... 37/406; 30/134; 144/34.5, 4.1; 83/928
See application file for complete search history.

(56) References Cited

U.S. PATENT DOCUMENTS 3,731,720 A * 5/1973 Moser et al. ..... 144/4.1
4,116,250 A * 9/1978 Ericsson ..... 144/34.1
4,221,245 A * 9/1980 Wildey ..... 144/34.1
4,384,599 A * 5/1983 Dagenais ..... 144/34.5

(Continued)

FOREIGN PATENT DOCUMENTS

CA 1080586 A1 7/1980
JP 06-306884 A 11/1994

(Continued)

OTHER PUBLICATIONS

Extended European Search Report (EESR) dated Apr. 8, 2014 (in English) issued in counterpart European Application No. 11829438.8.

(Continued)

*Primary Examiner* — Matthew D Troutman
(74) *Attorney, Agent, or Firm* — Holtz, Holtz, Goodman & Chick PC

(57) ABSTRACT

A cutting device for cutting a material grappled by a grapple member of a grapple device is mounted on one side wall portion of a bucket which is pivotable vertically with respect to an arm swung vertically and is rotatable on an axis in an extension direction of the arm. The cutting device includes a cutting blade which is positioned outside or inside a side wall of the bucket and is pivotally supported on a base end portion of the open mouth portion of the bucket to be pivoted in a direction along the side wall from a position separated from an opening edge of the bucket to a position along the side wall of the bucket. A hydraulic cylinder is provided on a rear surface portion of the bucket and is connected to a pivoting base portion of the blade.

8 Claims, 11 Drawing Sheets

(56) References Cited

U.S. PATENT DOCUMENTS

| | | | | |
|---|---|---|---|---|
| 4,452,286 | A * | 6/1984 | Menzi | 144/34.1 |
| 6,343,633 | B1 * | 2/2002 | Larsson | 144/34.5 |
| 6,655,053 | B1 | 12/2003 | Cummungs | |
| 6,779,570 | B2 * | 8/2004 | Tardif | 144/4.1 |
| 7,526,885 | B2 * | 5/2009 | Peterson et al. | 37/406 |
| 2007/0130808 | A1 * | 6/2007 | Peterson et al. | 37/406 |
| 2009/0229433 | A1 | 9/2009 | Kovalenko et al. | |

FOREIGN PATENT DOCUMENTS

| | | | |
|---|---|---|---|
| JP | 06-343356 | A | 12/1994 |
| JP | 11-036355 | A | 2/1999 |
| JP | 2008-133640 | A | 6/2008 |

OTHER PUBLICATIONS

International Search Report (with English translation) issued on Jan. 10, 2012, in International Application No. PCT/JP2011/073157.

PCT/ISA/220 issued on Jan. 10, 2012, in International Application No. PCT/JP2011/073157.

PCT/ISA/237 issued on Jan. 10, 2012, in International Application No. PCT/JP2011/073157.

PCT/ISA/416 & PCT/ISA/409 issued on Nov. 6, 2012, in International Application No. PCT/JP2011/073157.

International Preliminary Report on Patentability (IPRP) dated Apr. 4, 2013 (in English) issued in parent International Application No. PCT/JP2011/073157.

* cited by examiner

GRAPPLE BUCKET APPARATUS

TECHNICAL FIELD

The present invention relates to a grapple bucket apparatus that can excavate a ground surface, grapple (grasp) a material to be grappled such as lumber and the like and further, cut the material which is grappled.

BACKGROUND ART

A grapple bucket apparatus which is disclosed in Japanese Patent Application Laid-Open No. H11-36355 is composed of, a bucket connected to at a front end portion of an arm of a construction machine which is vertically swung, to be pivotable vertically, and a grapple device including two grapple members spaced substantially at the same interval as an opening width of the bucket and pivotally supported on a base end portion of an open mouth portion of the bucket to be pivotable in a direction to close the open mouth portion of the bucket.

A configuration of the conventional grapple bucket apparatus will be described with reference to FIGS. 1 to 3.

In FIG. 1, reference numeral 1 represents a vehicle body for a conventional power shovel, reference numeral 2 represents a boom provided therein to be able to be swung up and down, reference numeral 3 represents an arm connected to a front end of the boom 2, and reference numerals 4 and 5 represent cylinder devices for the boom and the arm to swing them up and down, respectively. In addition, reference numeral 6 in the drawing represents a grapple bucket apparatus mounted on a front end of the arm 3.

As illustrated in FIGS. 2 and 3, the grapple bucket apparatus 6 includes a bracket 7 connected to the front end of the arm 3 to be pivotable vertically, a bucket 8 supported on a front end of the bracket 7 to be rotatable on an axis in an extension direction of the arm 3, and a grapple device 9 mounted on a base end portion of an open mouth portion of the bucket 8 to be pivotable in a direction to face the open mouth portion of the bucket 8.

A cylinder device 10 for a bucket provided along the arm 3 is connected to an upper portion of the bracket 7 through a link mechanism 11. Further, the bucket 8 is rotated by a hydraulic motor 12 provided in the bracket 7 through a ring gear and a pinion (not illustrated). A plurality of digging teeth 8*a* is attached to a front end of the bucket 8. Further, there may be a bucket 8 not provided with the digging teeth 8*a*.

The grapple device 9 includes, a rotational shaft 14 pivotally supported on a bracket 13 provided at the base end portion of the open mouth portion of the bucket 8 in parallel to an opening width direction of the bucket 8, and two grapple members 15*a* and 15*b* of which base portions are fastened to both end portions of the rotational shaft 14 and which are curved in a concave shape to face the open mouth portion of the bucket 8. In addition, front ends of both the grapple members 15*a* and 15*b* are connected with a connection plate 16 for reinforcement of them as one purpose so that a long material is easily grappled. The interval between both the grapple members 15*a* and 15*b* is substantially the same as the opening width of the bucket 8, but an interval between front end portions of both the members is narrower than an inside dimension of the bucket 8 and the front end portions thereof are inserted into the bucket 8 along an inner wall surface of the bucket 8 with a small clearance. Further, the connection plate 16 is positioned inside the digging teeth 8*a* (the front end edge of the bucket when there is not digging teeth 8*a*) and further, extends along a bottom wall surface of the bucket 8 with a small clearance. Outer end step portions where the thicknesses of both the grapple members 15*a* and 15*b* are changed are configured as stoppers 17 that contact opening edges of the bucket 8. A saw blade-shaped gripping blade 16*a* is formed at the connection plate 16. Further, the gripping blade 16*a* of the connection plate 16 may have a linear shape.

A bracket 18 is provided in a protruding condition on the rotational shaft 14, the one end portion of a grappling cylinder device 19 of which the other end portion is pivotally supported in the bracket 13 provided at the base end portion of the bucket 8 is connected to the bracket 18, and the grapple members 15*a* and 15*b* are pivoted with respect to the bucket 8 by an extension and contraction operation of the cylinder device 19.

In the grapple bucket apparatus 6 configured as above, the boom 2 and the arm 3 are swung up and down and the bucket 8 is pivoted by extending and contracting the boom, arm, and bucket cylinder devices 4, 5, and 10, and as a result, vertical and anteroposterior positions and attitudes of the grapple bucket apparatus 6 are changed and further, a horizontal attitude of the bucket 8 is changed by rotating the bucket 8 with respect to the bracket 7.

In grappling a lumber, in addition to the above mentioned operation, the grapple members 15*a* and 15*b* are pivoted with respect to the bucket 8 by extending and contracting the grappling cylinder device 19. As a result, as represented by a chain line of FIG. 3, a lumber 20 is grappled between the grapple members 15*a* and 15*b* and both side walls of the open mouth portion of the bucket 8. In this case, by picking up the lumber 20 or changing a direction thereof with the connection plate 16 and the front end portion of the bucket 8, an attitude of the lumber 20 is trimmed so as to be easily grappled.

In excavating the ground surface, the grapple members 15*a* and 15*b* are pivoted to the bucket 8 side by extending the grappling cylinder device 19. As a result, as represented by a solid line of FIG. 3, front end portions of the grapple members 15*a* and 15*b* are inserted into the bucket 8 along both inner surfaces of the bucket 8 and further, the connection plate 16 is also located along the bottom wall surface of the bucket 8 inside the digging teeth 8*a* of the bucket 8.

In this state, the front end portions of the grapple members 15*a* and 15*b* and the connection plate 16 do not interrupt the excavation operation of the bucket 8 and as a result, the excavation operation by the bucket 8 is performed by extending and contracting cylinder device 4, 5, or 10 each.

The conventional grapple bucket apparatus mentioned above can perform both excavation of the ground surface and grappling of the lumber, and particularly, an operational effect in which the lumber can be piled up at a predetermined place may be expected by driving the construction machine while the lumber is grappled.

However, when the grappled lumber is long, the grappled lumber may contact the other thing, for example, a clump of trees near a forest road while the grappled lumber is transported, so that it becomes impossible to transport the lumber.

In this case, a worker needs to cut a lumber having a length longer than predetermined length into lumbers each having a predetermined length by using a cutting device such as a chain-saw and the like.

Further, the worker heretofore cuts each of lumbers after logging into a predetermined length, and the cutting work itself is a heavy labor and a burden to the worker.

Moreover, standing trees cannot be logged by using the conventional grapple bucket apparatus.

In view of the aforementioned, it is an object of the present invention to provide a grapple bucket apparatus that can cut materials such as a lumber grappled by using a grapple device in the state that the materials are grappled, so that the apparatus can simply cut and log the grappled materials after logging or standing trees before logging to reduce a burden of the worker and can, in advance, cut long materials grappled by using a grapple device before transporting the grappled materials to allow the grappled materials to be transported without a trouble in which the grappled materials contact the other things.

DISCLOSURE OF THE INVENTION

In order to solve the problems, a grapple bucket apparatus according to the present invention comprises, a bucket connected to a front end portion of an arm of a construction machine which is vertically swung, to be vertically pivotable and further, to be rotatable on an axis in an extension direction of the arm, and a grapple device including a grapple member pivotally supported on a base end portion of an open mouth portion of the bucket to be pivotable in a direction to close the open mouth portion of the bucket, the grapple member being capable of grappling a material to be grappled such as a lumber between the grapple member and an opening edge of the bucket, the apparatus including: a cutting device mounted on one side wall portion of the bucket and configured to cut the material grappled by using the grapple member, wherein the cutting device includes a cutting blade which is positioned at either the outside or the inside of the side wall of the bucket and is pivotally supported on a base end portion of the open mouth portion of the bucket to be pivoted in a direction along a side wall from a position separated from an opening edge of the bucket to a position along the side wall of the bucket, the cutting blade having a cutting edge on its side edge opposed to an opening edge of the bucket, and a hydraulic cylinder which is provided on a rear surface portion of the bucket and is connected to an arm protruding from a pivoting base portion of the cutting blade.

In the grapple bucket apparatus, a push-cut receiving frame in which a cutting blade is insertable is provided at a side wall portion of the bucket and a grappled material to be cut by the cutting blade is received by the push-cut receiving frame.

Further, the cutting edge of the cutting blade is formed at a position which deviates in a cutting direction of the cutting blade relative to a line connecting a pivoting center of the cutting blade and a connection point of the cutting blade with the hydraulic cylinder and the blade is curved in an arc shape rearward with respect to a pivoting direction which is the cutting direction.

In addition, the grapple device has a configuration in which two grapple members are spaced at substantially the same interval as an opening width of the bucket, front end portions of the two grapple members are inserted into the bucket or contacted with a front end of the bucket, and the front end portions of the two grapple members are connected to each other with a connection member or a space between the two grapple members of which front end portions are connected to each other with the connection member is bridged with a cover member such as a plate member or a grating member.

According to the present invention, in the grapple bucket apparatus, a material such as a lumber grappled on an opening side of the bucket can be cut by using the cutting device in the state that the material is grappled with the grapple device.

Accordingly, since the lumber after logging can be simply cut by using the cutting device of the grapple bucket apparatus, a burden of a worker can be reduced. In addition, before the material grappled by using the grapple device is transported, when the grappled material is long, the grappled material is cut in advance to prevent a trouble such as a contact of the grappled material with the other thing.

Further, according to the present invention, even though the material to be grappled is a standing tree before logging, the standing tree can be easily cut in the state that the standing tree is grappled by using the grapple device and the grappled material can be logged within a short time and without labor as compared with a logging work by a chain-saw and the like.

Further, the cover member such as the plate member or the grating member is provided between two grapple members constituting the grapple device to scoop up a small material with the cover member while grappling the grappled material by using the grapple device.

BEST MODES FOR CARRYING OUT THE INVENTION

Figure 1:
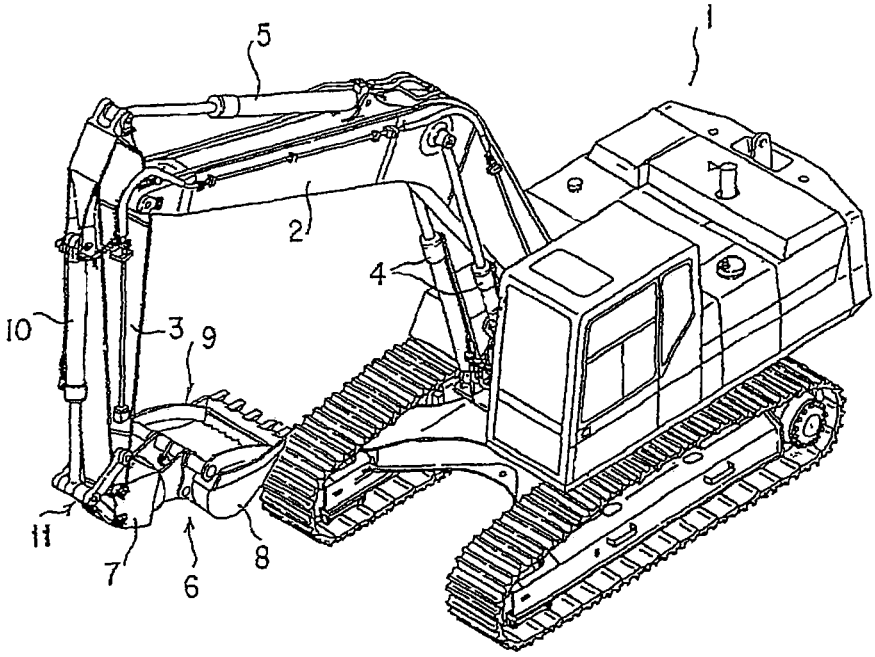
Prior Art Fig. 1
FIG. 1 is a perspective view illustrating a state in which a conventional grapple bucket apparatus is mounted on a working machine.
Figure 2:
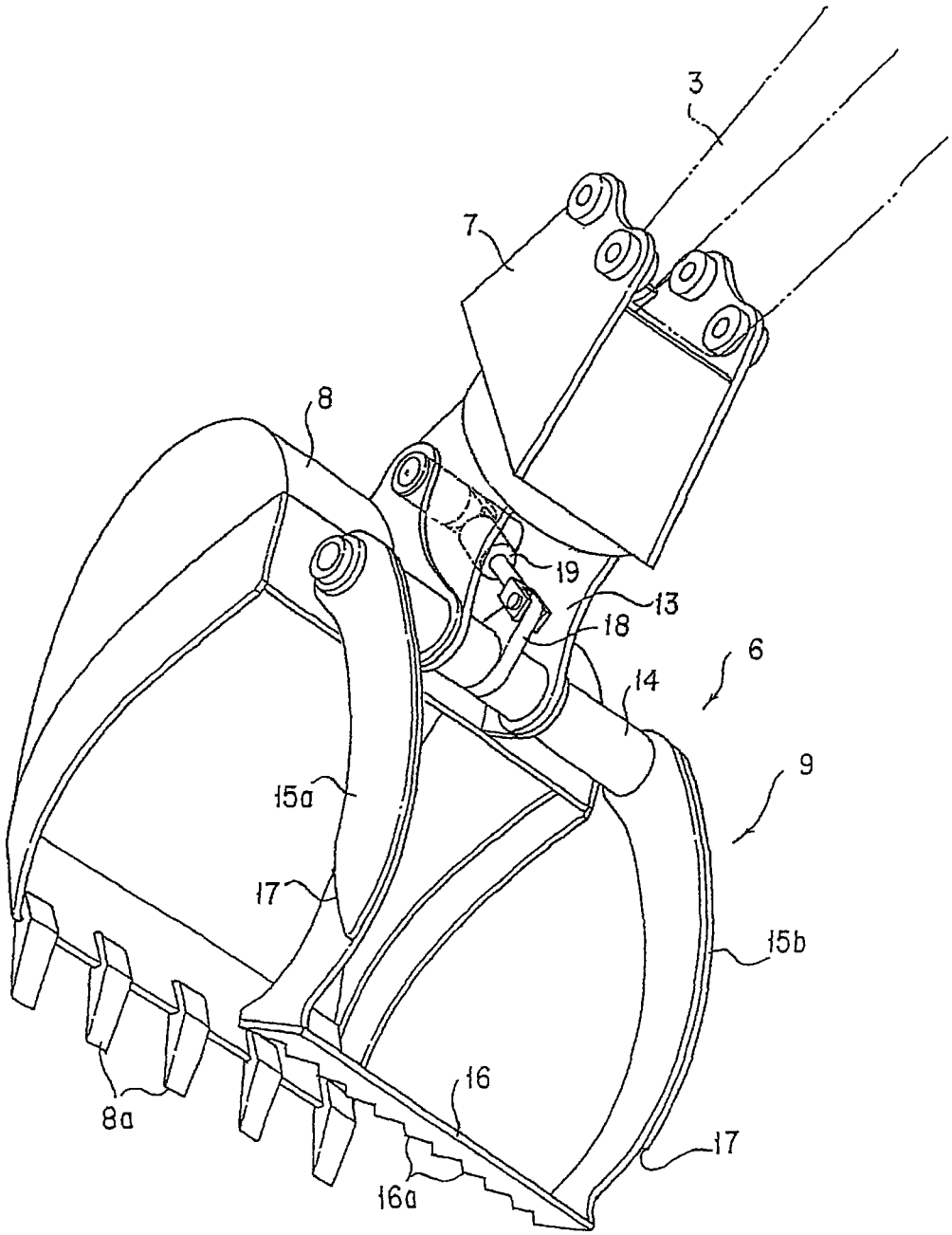
Prior Art Fig. 2
FIG. 2 is a perspective view illustrating one example of the conventional grapple bucket apparatus.
Figure 3:
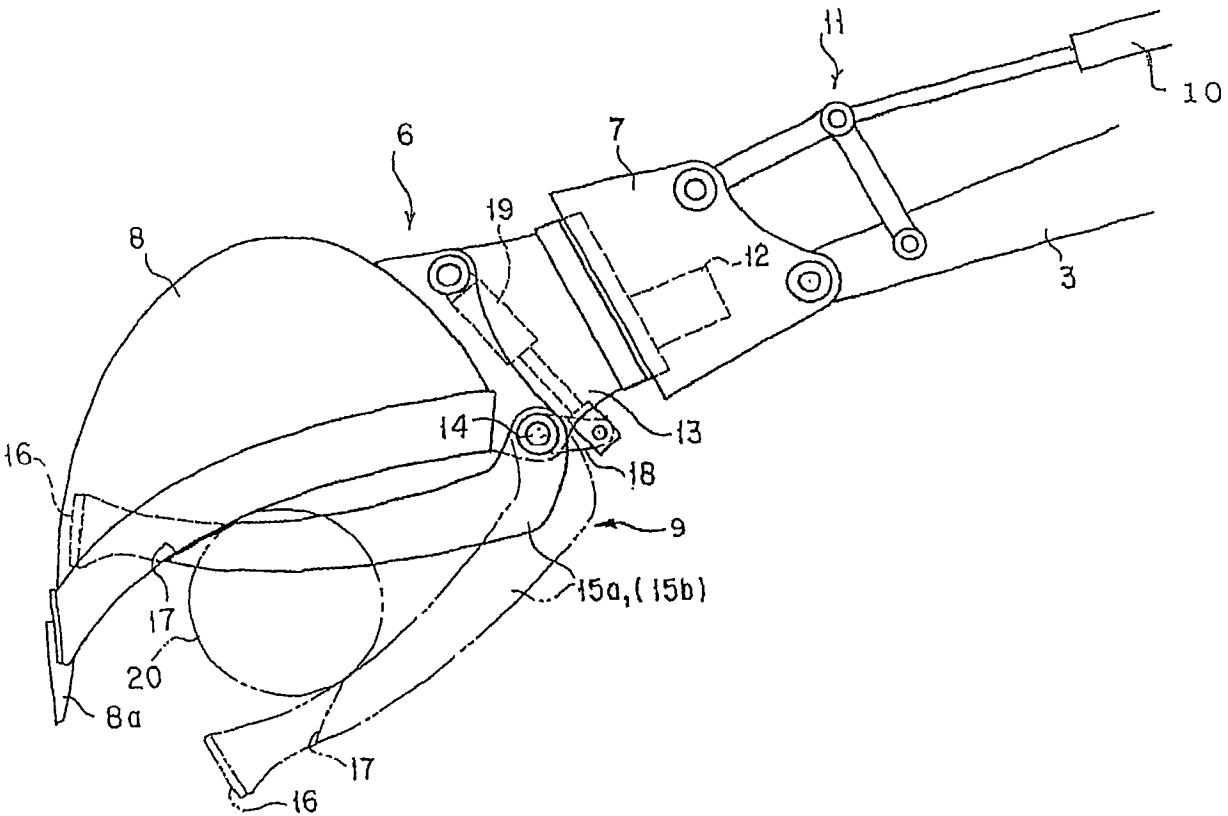
FIG. 3 is a side view illustrating one example of the conventional grapple bucket apparatus.
Figure 4:
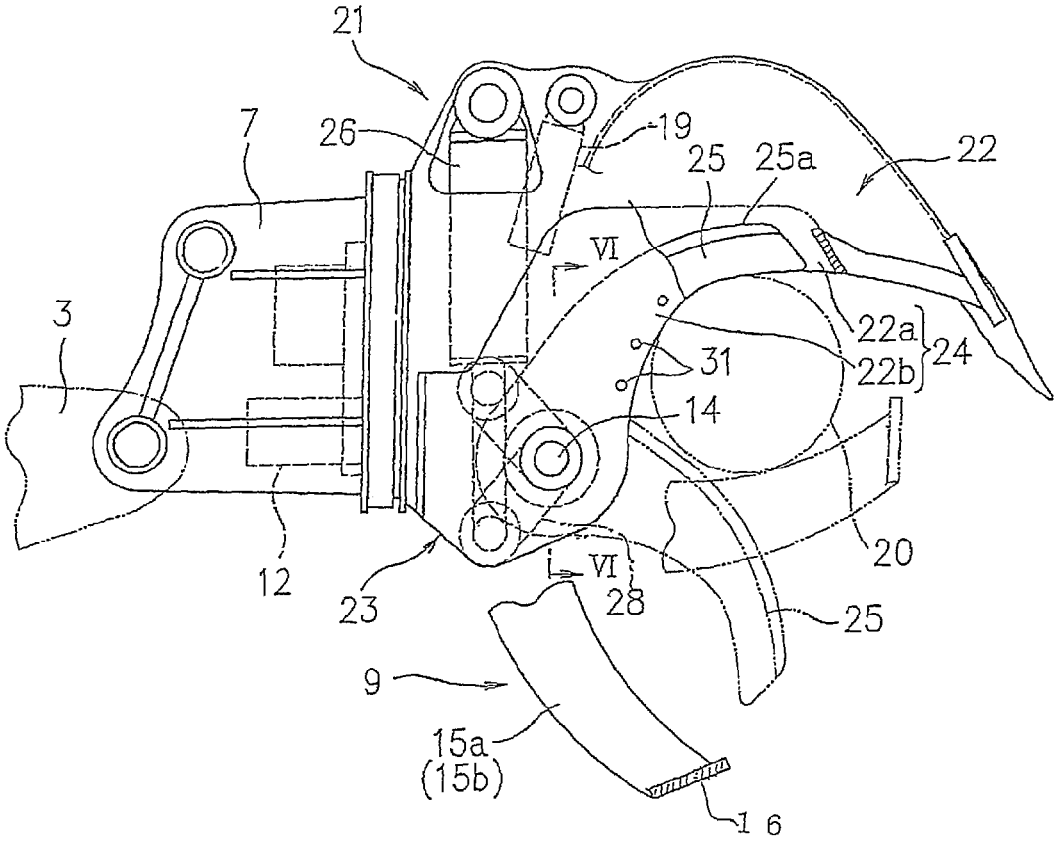
FIG. 4 is a side view in part broken and cross sectional illustrating an embodiment of a grapple bucket apparatus according to the present invention.
Figure 5:
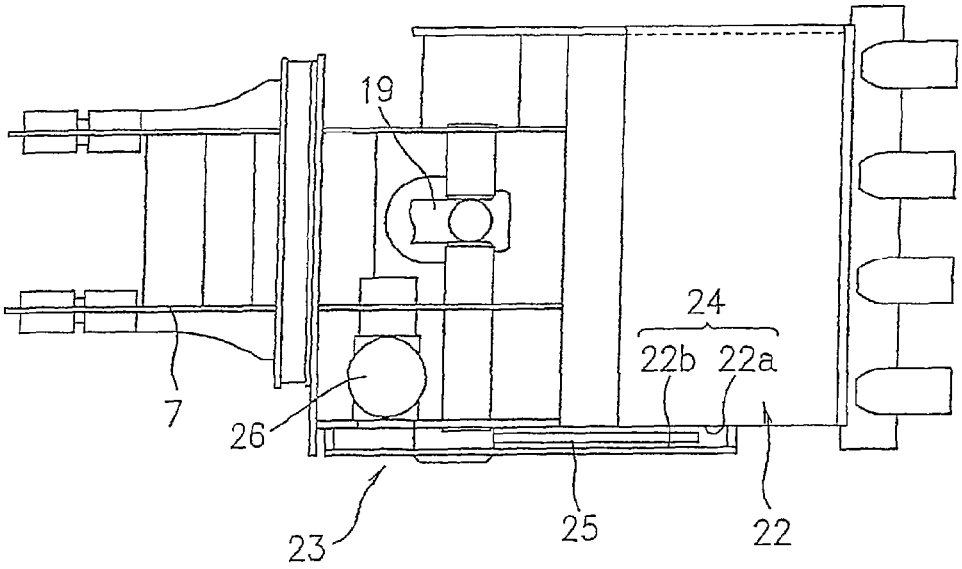
FIG. 5 is a plan view illustrating the embodiment of the grapple bucket apparatus according to the present invention.

Primary parts of an embodiment of the present invention will be described based on FIG. 4 and following figures. Further, a grapple bucket apparatus according to the present invention is built by adding a cutting device to the conventional grapple bucket apparatus and in the following description, the same reference numerals refer to the same members as those of the conventional apparatus.

A grapple bucket apparatus 21 mounted on a front end of an arm 3 includes a bracket 7 connected to the front end of the arm 3 to be vertically pivotable, a bucket 22 supported on a front end of the bracket 7 to be rotatable on an axis in an extension direction of the arm 3, a grapple device 9 pivotally mounted on a base end portion of an open mouth portion of the bucket 22 in a direction to face the open mouth portion of the bucket 22, and a cutting device 23 mounted on either one of side portions in width direction of the bucket 22, that is, a right side portion when the open mouth portion is viewed from behind in the embodiment. The bucket 22 has substantially the same structure as the conventional bucket 8.

The cutting device 23 includes, a right side wall 22*a* of the bucket 22, a push-cut receiving frame 24 composed of the right side wall 22*a* and a frame wall 22*b* provided outside the side wall 22*a* leaving a predetermined interval, a cutting blade 25 interposed in the push-cut receiving frame 24 and pivotably supported on a rotational shaft 14 of the grapple device 9, and a cylinder device 26 provided on a rear surface portion of the bucket 22 and pivoting the cutting blade 25.

A shape of an opening side of the push-cut receiving frame 24 composed of the side wall 22*a* and the frame wall 22*b* is the same as a shape of an opening side of the bucket 22, that is, a concave arc shape, and is a shape along the outer periphery of the lumber 20 grappled by the grapple members 15*a* and 15*b* of the grapple device 9.

Figure 6:
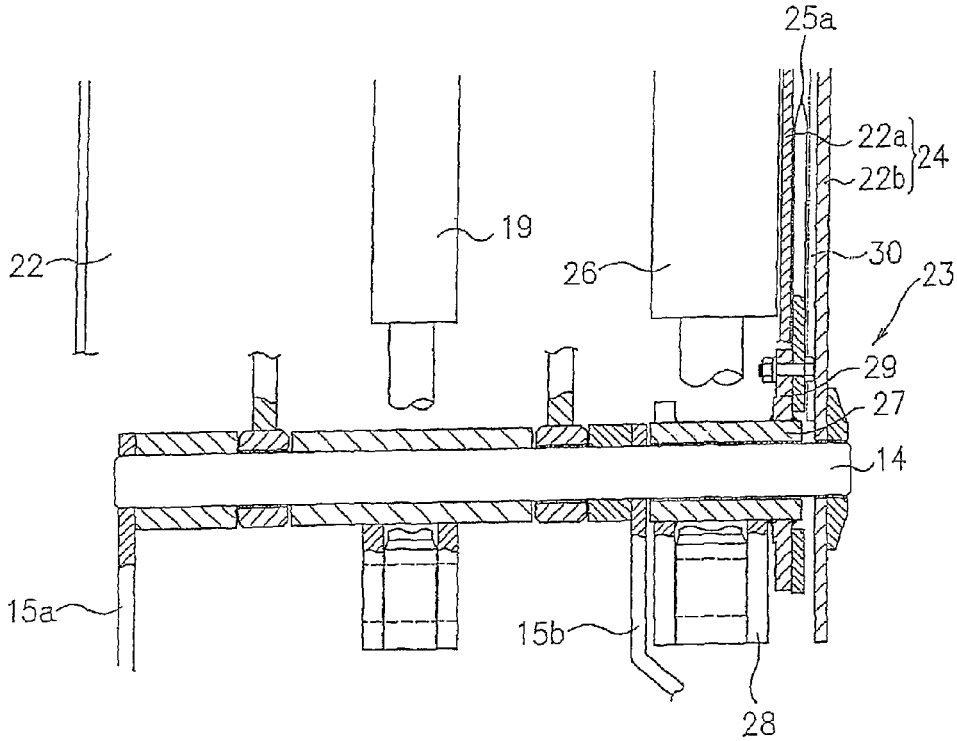
FIG. 6 is a cross-sectional configuration diagram taken along line VI-VI of FIG. 4.

In FIG. 6, a boss member (pivoting base portion) 27 of the cutting blade 25 is pivotally supported on a rotational shaft 14 rotated by the cylinder device 19 of the grapple device 9 to be pivotable, a front end portion of the cylinder device 26 is connected to an arm 28 that is provided in a protruding condition on the boss member 27, and the cutting blade 25 is pivoted in a direction to appear and disappear with respect to the push-cut receiving frame 24 by extension and contraction of the cylinder device 26. Further, the cutting blade 25 is attached to a disk member 29 fixed to the boss member 27 by a bolt.

Figure 7:
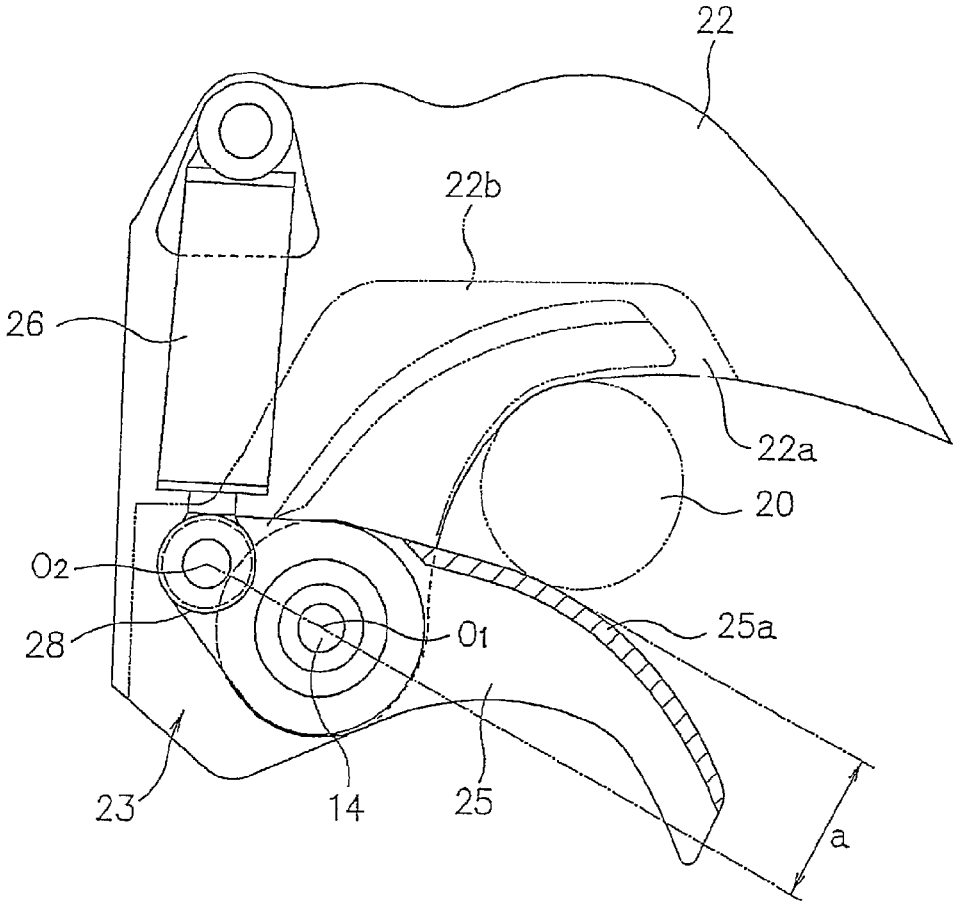
FIG. 7 is an explanatory diagram illustrating the position of a cutting edge of a cutting blade relative to a line connecting a pivot center of the cutting blade and a connection point of the cutting blade with a hydraulic cylinder.

A side edge, at a side inserted into the push-cut receiving frame 24, of the cutting blade 25 is a cutting edge 25*a*. This cutting edge 25*a* is curved in an arc shape rearward with respect to a pivoting direction to the push-cut receiving frame 24 side and has a so called falchion shape. As illustrated in FIG. 7, the cutting edge 25*a* of the cutting blade 25 is formed at a position which deviates by a dimension a to an opening edge side of the bucket 22 relative to a line connecting a pivot center O1 of the cutting blade 25 and a connection point O2 of the arm 28 with the hydraulic cylinder 26.

In the above configuration, the cutting blade 25 is operated to move to the bucket 22 side, that is, in a closing direction by extending the cylinder device 26 of the cutting device 23 while the lumber 20 is grappled between the opening edge of the bucket 22 and the grapple members by operating the grapple device 9, and as a result, the lumber 20 is push-cut by the cutting blade 25. In this case, by changing an attitude of the bucket 22 by rotating the bucket 22 with respect to the arm 3, both a lumber logged and tumbled aside and a lumber as a standing tree before logging can be cut by using the cutting device 23.

The lumber 20 at that time is supported on the push-cut receiving frame 24 at the bucket 22 side, and the cutting blade 25 is operated toward the inside of the push-cut receiving frame 24, and as a result, the lumber 20 is supported by the push-cut receiving frame 24 without being inclined in spite of receiving cutting force by the cutting blade 25.

In this case, the cutting edge 25*a* of the cutting blade 25 is curved in the arc shape rearward with respect to the pivoting direction which is the cutting direction and the cutting edge 25*a* of the cutting blade 25 deviates to the cutting direction side relative to a line connecting the pivot center O1 of the cutting blade 25 and the connection point O2 of the arm 28 with the hydraulic cylinder 26 so as to smoothly push-cut the lumber 20 grappled by the grapple device 9 by using the cutting blade 25.

In order to smoothly cut the lumber 20 by using the cutting blade 25 as described above, it is preferable that a frame wall interval of the push-cut receiving frame 24 is narrow similarly as the thickness of the cutting blade 25 and an interval between the side surface of the cutting blade 25 and the frame wall is small. Therefore, when the frame wall interval becomes larger than the thickness of the thin cutting blade 25 by replacing the cutting blade 25 according to the type and size of the logged lumber, the interval between the side surface of the cutting blade 25 and the frame wall is adjusted by attaching a spacer 30 to the inside of the frame wall 22*b* of the push-cut receiving frame 24 as represented by a chain line in FIG. 6. The attachment of the spacer 30 is carried out by fixing the spacer 30 on an inner surface of the frame wall 22*b* with bolts passing through bolt holes 31 provided on the frame wall 22*b*. Further, in this case, the cutting blade 25 is preferably positioned at the center of an interval between opposed walls of the push-cut receiving frame 24.

In addition, in the above embodiment, the example in which the side wall 22*a* of the bucket 3 is used as the inner frame wall of the push-cut receiving frame 24 has been described, but the inner frame wall of the push-cut receiving frame 24 may be configured by an additional plate material fixed to the outside of the side wall 22*a* of the bucket 3.

Further, in the above embodiment, the example in which the push-cut receiving frame 24 is composed of the side wall 22*a* of the bucket 22 and the frame wall 22*b* and the lumber 20 is supported by the push-cut receiving frame 24 has been described, but when the lumber 20 to be cut is rigidly grappled by using the grapple device 9, the push-cut receiving frame 24 may be composed of only the side wall 22*a* of the bucket 22.

Further, in the cutting blade 25 illustrated in FIG. 6, parts other than the cutting edge 25*a* have the same thickness, but a plate thickness of the parts other than the cutting edge may be thinned in a tapered shape from the boss portion to the front end, and as a result, improvement of sharpness of the cutting blade 25 may be expected.

Figure 8:
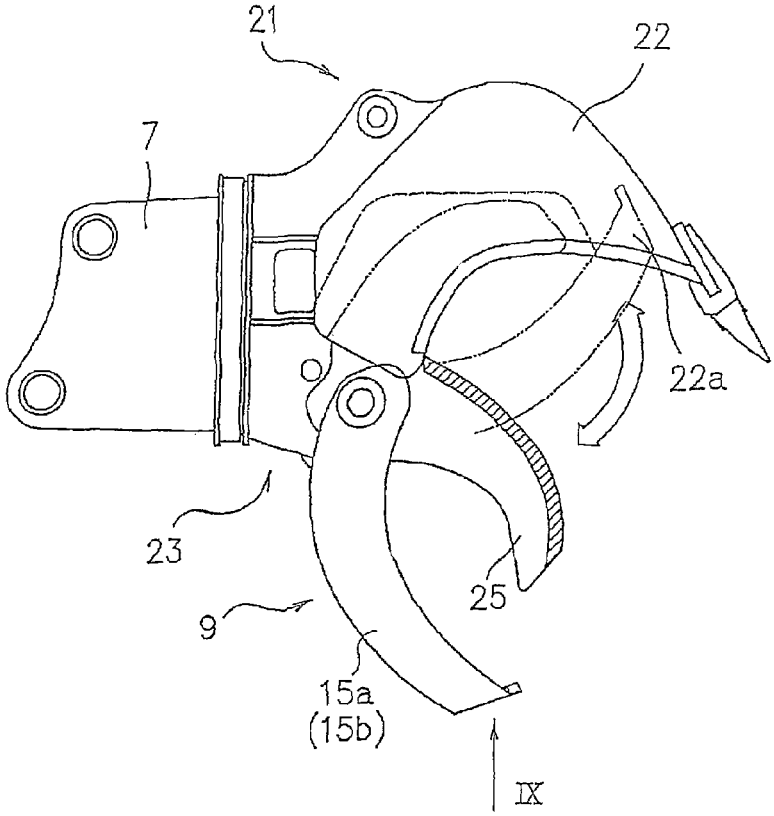
FIG. 8 is a side view illustrating an example in which the cutting blade is provided inside a side wall of a bucket.

FIG. 8 and following figures illustrate other embodiments different from the aforementioned embodiment.

Figure 9:
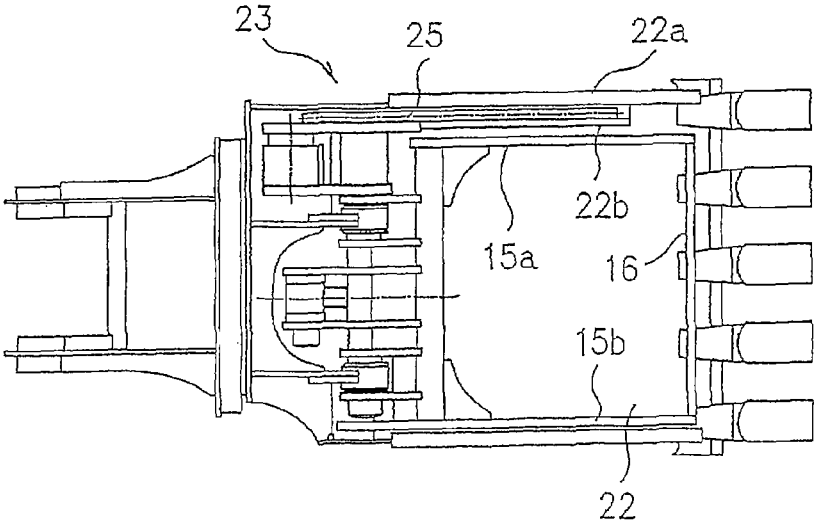
FIG. 9 is a view as seen in the direction of the arrow IX in FIG. 8.

In the embodiment illustrated in FIGS. 8 and 9, the cutting blade 25 is disposed inside the side wall 22*a* of the bucket 8. In this case, the frame wall 22*b* of the push-cut receiving frame 24 is provided inside the bucket 8. In addition, the grapple members 15*a* and 15*b* of the grapple device 9 are inserted into the bucket 22.

Figure 10:
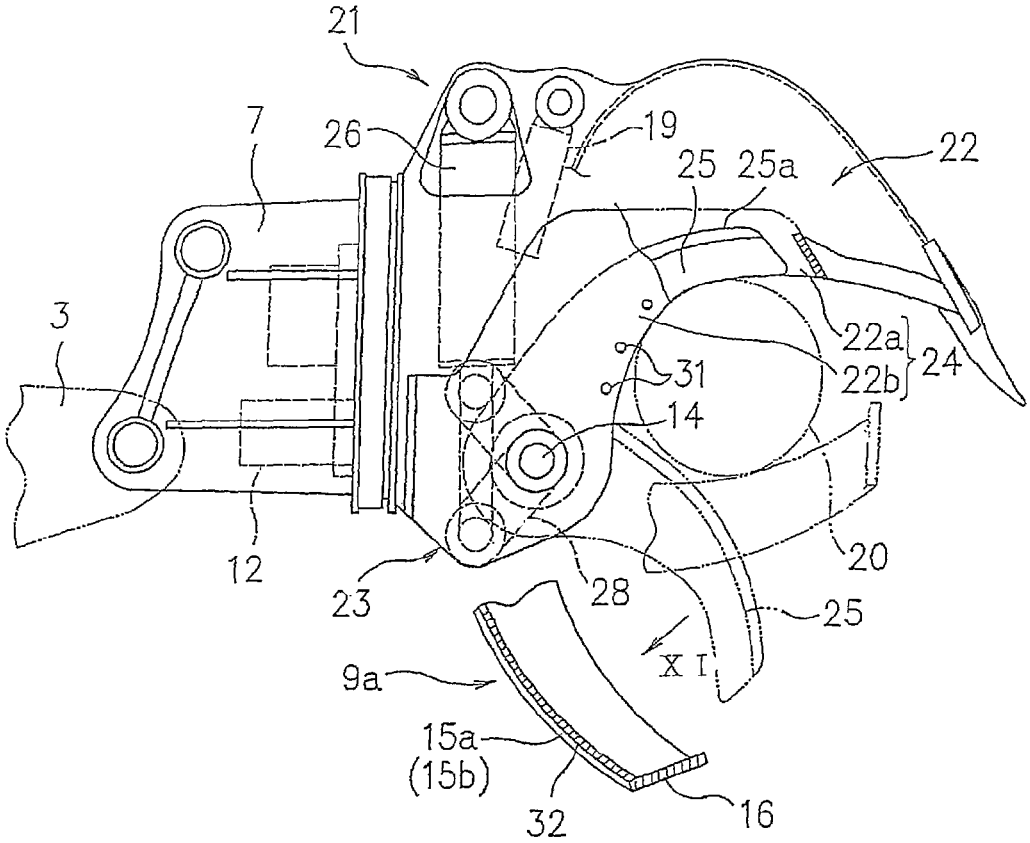
FIG. 10 is a side view in part broken and cross sectional illustrating another example of a grapple member.
Figure 11:
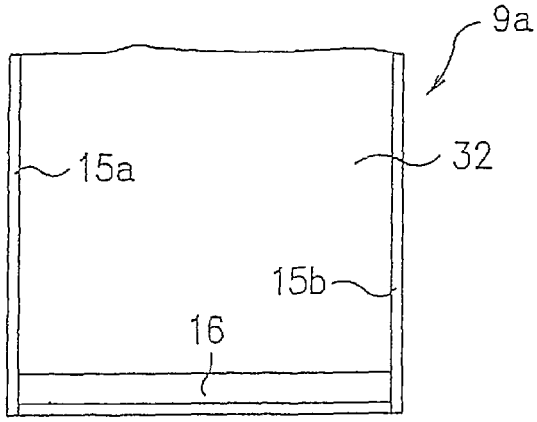
FIG. 11 is a view as seen in the direction of the arrow XI in FIG. 10.

FIGS. 10 to 14 illustrate another example of the grapple device used in the present invention and a grapple device 9*a* illustrated in FIGS. 10 and 11 has a configuration in which a space between left and right grapple members 15*a* and 15*b* is bridged with a plate member 32.

According to this embodiment, when the grapple device 9*a* is operated to be closed, an object in the grapple bucket apparatus 6 can be covered even with the plate member 32 together with the left and right grapple members 15*a* and 15*b*. Further, the object can be scooped into the plate member 32 inside the grapple device 9*a*.

Figure 12:
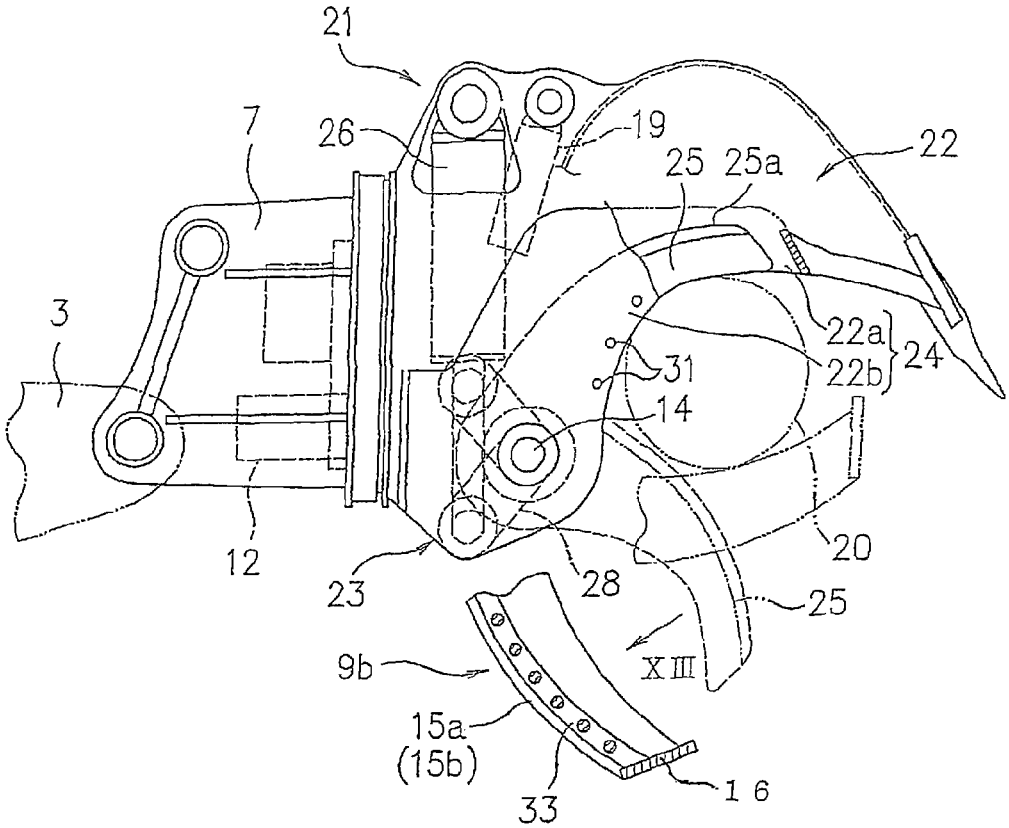
FIG. 12 is a side view in part broken and cross sectional illustrating another example of the grapple member.
Figure 13:
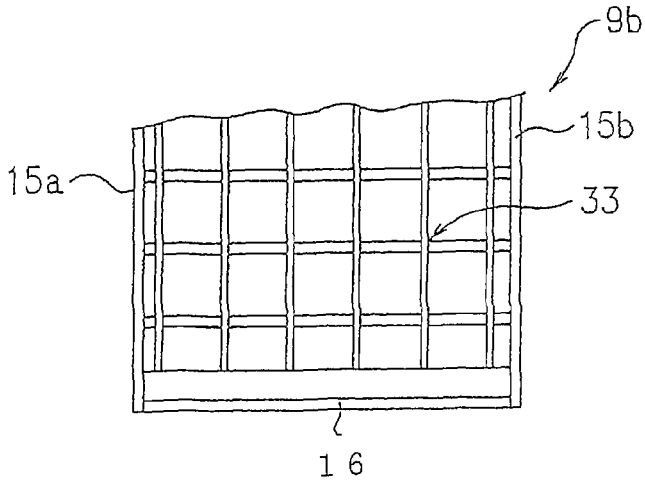
FIG. 13 is a view as seen in the direction of the arrow XIII in FIG. 12.

A grapple device 9*b* illustrated in FIGS. 12 and 13 has a configuration in which the space between the left and right grapple members 15*a* and 15*b* is bridged with a grating member 33.

According to this embodiment, like as the embodiment illustrated in FIGS. 10 and 11, the object may be scooped into the grapple device 9*b* and the scooped object may be shifted by using the grating member 33.

Figure 14:
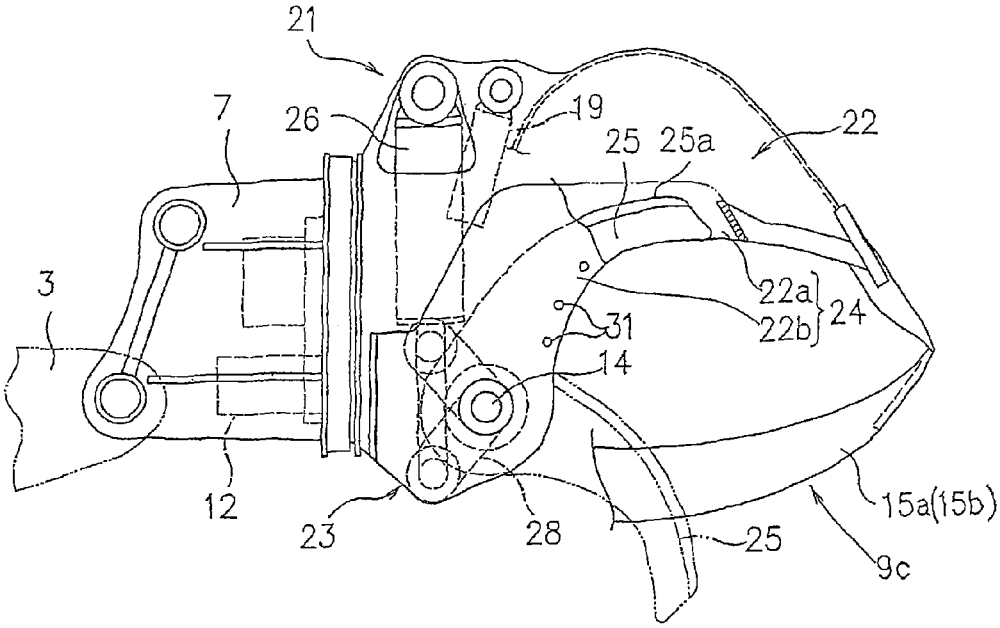
FIG. 14 is a side view illustrating another example of the grapple member.

In the respective embodiments, the front end portions of the grapple members 15*a* and 15*b* of the grapple devices 9, 9*a*, and 9*b* are inserted into the bucket 8, but in a grapple device 9*c* illustrated in FIG. 14, the front end portions of the grapple members 15*a* and 15*b* are opposite to the front end of the bucket 8, and thereby the front end portions thereof contact the front end of the bucket 8. Further, in this case, the digging teeth are not provided at the front end portion of the bucket 8 and the front end portion of the bucket 8 is configured as a linear front end edge. In addition, in this case a space is just given between the left and right grapple members 15*a* and 15*b* of the grapple device 9*c* or the space between the grapple members 15*a* and 15*b* is bridged with the plate member or the grating member.

The invention claimed is:

1. A grapple bucket apparatus comprising:

a bucket which is adapted to be connected to a front end portion of an arm of a construction machine which is vertically swung, the bucket being configured to be vertically pivotable, and to be rotatable on an axis in an extension direction of the arm;

a grapple device including a grapple member pivotally supported on a base end portion of an open mouth portion of the bucket to be pivotable in a direction to close the open mouth portion of the bucket, the grapple member being capable of grappling a material to be grappled between the grapple member and an opening edge of the bucket; and a cutting device mounted on one side wall portion of the bucket and configured to cut the material grappled by using the grapple member, wherein the cutting device includes:

a cutting blade which is positioned at either an outside or an inside of a side wall of the bucket and is pivotally supported on the base end portion of the open mouth portion of the bucket to be pivoted in a direction along the side wall from a position separated from the opening edge of the bucket to a position along the side wall of the bucket, the cutting blade having a cutting edge on a side edge thereof opposed to the opening edge of the bucket, a hydraulic cylinder which is provided on a rear surface portion of the bucket and is connected to a pivoting base portion of the cutting blade, and a push-cut receiving frame in which the cutting blade is insertable and is provided at the side wall portion of the bucket, wherein the push-cut receiving frame is configured to support the material grappled by the grapple member while being cut by the cutting blade, and wherein the cutting blade takes the position along the side wall of the bucket immediately after performing cutting of the material grappled by the grapple member.

2. The grapple bucket apparatus according to claim 1, wherein:

the cutting edge of the cutting blade is formed at a position which deviates in a cutting direction of the cutting blade relative to a line connecting a pivoting center of the cutting blade and a connection point of the cutting blade with the hydraulic cylinder, and the cutting blade is curved in an arc shape rearward with respect to a pivoting direction which is the cutting direction.

3. The grapple bucket apparatus according to claim 1, wherein:

the grapple device comprises two grapple members which are spaced at substantially a same interval as an opening width of the bucket, front end portions of the two grapple members are configured to be insertable into the bucket or contactable with a front end of the bucket, and the front end portions of the two grapple members are connected to each other with a connection member.

4. The grapple bucket apparatus according to claim 3, wherein a space between the two grapple members is bridged with a cover member.

5. The grapple bucket apparatus according to claim 4, wherein the cover member is one of a plate member and a grating member.

6. The grapple bucket apparatus according to claim 2, wherein:

the grapple device comprises two grapple members which are spaced at substantially a same interval as an opening width of the bucket, front end portions of the two grapple members are configured to be insertable into the bucket or contactable with a front end of the bucket, and the front end portions of the two grapple members are connected to each other with a connection member.

7. The grapple bucket apparatus according to claim 6, wherein a space between the two grapple members is bridged with a cover member.

8. The grapple bucket apparatus according to claim 7, wherein the cover member is one of a plate member and a grating member.

* * * * *